US010544625B2

(12) United States Patent
Strange et al.

(10) Patent No.: US 10,544,625 B2
(45) Date of Patent: Jan. 28, 2020

(54) MULTI FLUID DRILLING SYSTEM

(71) Applicant: Strada Design Limited, St. Helier Jersey (GB)

(72) Inventors: Warren Strange, St. Helier Jersey (GB); Ian Speer, Gooseberry Hill (AU)

(73) Assignee: Strada Design Limited, St. Helier Jersey (GB)

( * ) Notice: Subject to any disclaimer, the term of this patent is extended or adjusted under 35 U.S.C. 154(b) by 103 days.

(21) Appl. No.: 15/542,111

(22) PCT Filed: Jan. 8, 2016

(86) PCT No.: PCT/AU2016/000002

§ 371 (c)(1),
(2) Date: Jul. 7, 2017

(65) Prior Publication Data

US 2018/0274299 A1 Sep. 27, 2018

(30) Foreign Application Priority Data

Jan. 8, 2015 (AU) ..... 2015900043

(51) Int. Cl.
*E21B 6/04* (2006.01)
*E21B 21/12* (2006.01)
(Continued)

(52) U.S. Cl.
CPC ..... *E21B 6/04* (2013.01); *E21B 3/04* (2013.01); *E21B 4/02* (2013.01); *E21B 4/14* (2013.01);
(Continued)

(58) Field of Classification Search
CPC . E21B 6/04; E21B 21/00; E21B 21/12; E21B 21/103; E21B 21/08; E21B 21/14;
(Continued)

(56) References Cited

U.S. PATENT DOCUMENTS 3,503,459 A * 3/1970 Schindler ..... E21B 4/14 173/80
4,393,944 A 7/1983 Gugger et al.
(Continued)

FOREIGN PATENT DOCUMENTS

| | | |
|---|---|---|
| EP | 0 233 038 | 2/1987 |
| WO | 00/55468 A1 | 9/2000 |
| WO | 2013/106890 A1 | 7/2013 |

OTHER PUBLICATIONS

International Search Report pertaining to PCT/AU2016/000002, dated Feb. 24, 2016, 3 pages.
(Continued)

*Primary Examiner* — David Carroll
(74) *Attorney, Agent, or Firm* — Dinsmore & Shohl, LLP

(57) ABSTRACT

A multi-fluid drilling system 10 drilling is disclosed for drilling a hole or well 11. The system 10 is coupled to a dual wall drill string 12. The drill string 12 is configured to enable separate flow of a first fluid 14 and a second fluid 16. The system 10 has a hammer 22 and a downhole motor 24. Both the hammer 22 and the motor 24 are supported by and are coupled to the drill string 12. The motor 24 is uphole of the hammer 22. The hammer 22 is arranged so that when supported by the drill string 12 the first fluid 14 when flowing through the drill string 12 is able to flow to and power the hammer 22. As the motor 24 is disposed between the hammer 22 and the drill string 12 the first fluid 14 is also able to flow through the motor 24. To this end the motor 24 has a channel 25 to enable the first fluid to flow from the drill sting 12 to the hammer 22. The channel 25 acts as a part of a flow path or conduit for the first fluid 14.

18 Claims, 5 Drawing Sheets

(51) Int. Cl.

| | |
|---|---|
| ***E21B 4/02*** | (2006.01) |
| ***E21B 21/08*** | (2006.01) |
| ***E21B 4/14*** | (2006.01) |
| ***E21B 7/04*** | (2006.01) |
| ***E21B 4/16*** | (2006.01) |
| ***E21B 3/04*** | (2006.01) |
| ***E21B 7/06*** | (2006.01) |
| ***E21B 21/00*** | (2006.01) |
| ***E21B 21/10*** | (2006.01) |
| *E21B 21/14* | (2006.01) |

(52) U.S. Cl.
CPC ..... *E21B 4/16* (2013.01); *E21B 7/04* (2013.01); *E21B 7/067* (2013.01); *E21B 21/00* (2013.01); *E21B 21/08* (2013.01); *E21B 21/103* (2013.01); *E21B 21/12* (2013.01); *E21B 21/14* (2013.01)

(58) Field of Classification Search
CPC ... E21B 7/067; E21B 7/04; E21B 4/02; E21B 4/14; E21B 4/16; E21B 4/145; E21B 4/10; E21B 10/36
See application file for complete search history.

(56) References Cited

U.S. PATENT DOCUMENTS 4,683,944 A * 8/1987 Curlett ..... E21B 17/003 166/65.1
4,726,429 A * 2/1988 Kennedy ..... E21B 4/14 173/62
4,852,669 A 8/1989 Walker
5,853,052 A * 12/1998 Baiden ..... E21B 4/02 173/15
6,047,778 A * 4/2000 Coffman ..... E21B 4/00 173/205
6,659,202 B2 * 12/2003 Runquist ..... E21B 4/16 175/107
6,742,605 B2 * 6/2004 Martini ..... E21B 4/10 175/107
2005/0126822 A1 * 6/2005 Campbell ..... E21B 4/06 175/57
2011/0232970 A1 * 9/2011 Miller ..... E21B 1/00 175/57
2015/0136492 A1 * 5/2015 Speer ..... E21B 21/12 175/70
2018/0044991 A1 * 2/2018 Speer ..... E21B 21/12

OTHER PUBLICATIONS

International Preliminary Report on Patentability pertaining to PCT/AU2016/000002, dated Mar. 14, 2017, 5 pages.

Extended European Search Report, dated Oct. 23, 2018, pertaining to EP16734859.8.

* cited by examiner

MULTI FLUID DRILLING SYSTEM

TECHNICAL FIELD

A system and method are disclosed for drilling a hole in the ground. The hole may be for example, but not limited to, exploration or production holes for hydrocarbons or access to subterranean geothermal sources, or waste storage holes.

BACKGROUND ART

Many types of ground drilling systems are available for drilling holes for particular purposes and in specific ground conditions. One range of downhole drill systems utilise a fluid under pressure to assist in advancing the drill. The fluid may act to either drive a drilling tool coupled to an associated drill string, or to flush drill cuttings from a hole being drilled, or both. The fluid can be a gas such as air or nitrogen, a liquid/slurry such as water or drilling mud, or a combination of a gas and liquid.

For oil and gas exploration and production it is common to use downhole motors which are driven by high specific gravity fluid such as drilling mud to provide rotation to an attached roller bit. The mud can also act to clear cuttings from the hole and provide downhole pressure control. Additionally the volumetric flow rate of mud through a mud motor may be sufficient to kill a well if required. However there is a limitation in terms of drilling in hard materials particularly with directional (i.e. non-vertical holes). This arises due to the inability to apply sufficient downhole pull-down or weight on bit ("WOB") to fracture rock and progress the drilling at an economical rate.

The limitation of penetration in hard materials can overcome by the use of a down the hole (DTH) hammer. DTH hammers are driven by a fluid. While air is a common driving fluid it does not enable control of downhole and ground pressure. Also it is often not possible to provide the air with the required pressure and volume to provide sufficient pressure differential with reference to the prevailing down hole environment to effectively drive the hammer.

Instead of air, water and additives such as drilling mud can used to drive the hammer. This enables higher drilling pressures to be provided to combat high ground pressures. However due to its inherent nature drilling mud rapidly wears the internal surfaces of the hammer leading to the need for frequent replacement. This involves the very time consuming process of tripping the drill string. Also conventional hammer drills do not enable a sufficient volumetric flow rate to kill a well (i.e. flood the well quickly to control or stop the flow of gas and other dangerous well conditions) in the event of a dangerous over pressure condition.

SUMMARY OF THE DISCLOSURE

In broad terms a drilling system and method are disclosed utilising a plurality of fluids to drive separate downhole devices. The separate downhole devices may comprising a hammer and downhole motor. A hammer bit is attached to the hammer and the hammer is downstream of the motor. The drilling system is coupled to a downhole end of a drill string. The drill string is arranged to enable the separate and independent flow of a first fluid and a second fluid. The first fluid is used to power the hammer. The second fluid is used to power the motor. Both fluids may be liquids. The liquids may, and often will, have different characteristics. The difference may be in terms of one or more of their specific gravity, viscosity, rheology, pressure and flow rate.

The downhole motor can be used to rotate the hammer. However it is also possible to stop flow of the second fluid to the downhole motor in which case the motor will not rotate the hammer. In that event rotation of the hammer can be provided by rotating the drill string for example by use of a surface rotary table or rotation head. In a further alternative torque can be provided to the bit by both the downhole motor and a surface rotary table or rotation head.

A steerable joint or sub may be provided between a downhole end of the drill string and the hammer. Thus the steerable joint or sub can be either between the end of the string and the motor, or between the motor and the hammer. However in an alternate embodiment the downhole motor may be steerable itself by the incorporation of an in-built adjustable bend.

The system is configured so that the second fluid can be discharged into the hole being drilled across the face of the hammer bit. Alternatively the second fluid may be discharged into the hole from a location close to the face of the bit; or from a location up hole of the hammer drill.

The use of multiple fluids makes it possible to optimise the system and method by appropriate selection of the fluids to meeting different their specific requirements. For example the first fluid can be optimised for operating the hammer in terms of power, speed, efficiency and longevity. On the other hand the second fluid may be optimised in terms of operating the motor and: clearing the hole of drill cuttings; hole stability; and, providing a desired downhole pressure condition, either by itself or when mixed with the first fluid in the event that the first fluid is into the hole exhausted after operating the hammer. The parameters or characteristic that may be selected for the second fluid include but are not limited to: up hole velocity, viscosity and specific gravity.

The first fluid may be denoted as a "power fluid" as this is the fluid that provides power to drive the down the hole hammer drill. It is the power fluid that flows through a porting arrangement of the hammer to reciprocate a piston which cyclically impacts the hammer bit of the hammer. In various embodiments the first fluid may comprise a liquid or a gas or combination thereof, such as but is not limited to: water, oil, air, nitrogen gas, or mixtures thereof.

The second fluid in addition to proving power to the motor has other functions which can be performed either simultaneously or separately in various circumstances. For example the second fluid may function as a flushing fluid to flush cuttings from the hole and in particular from near the bit face of the hammer bit. The second fluid may also be used to control downhole pressure. For this reason the second fluid may also be denoted as a "flushing fluid" or a "control fluid". The second fluid in most instances is a liquid such as but not limited to: water, drilling mud or in, for example dangerous over pressure conditions, cement/grout. In the event that water is used as the second fluid it is not of great significance to the operational life of the hammer if the water carries with it significant fractions of particulate material. That is dirty water may be used to operate the motor. Whereas clean water is preferable used for the hammer.

In a first aspect there is disclosed a multi-fluid drilling system capable of being coupled to an end of a drill string configured to enable separate and independent flow of a first fluid and a second fluid, the system comprising:

- a hammer arranged so that when supported by the drill string a first fluid flowing through the drill string is able to power the hammer drill; and
- a motor arranged so that when supported by the drill string a second fluid flowing through the drill string is able to flow through and power the motor;

the motor being coupled to the hammer and arranged to rotate the hammer when second fluid flows through the motor.

In a second aspect there is disclosed a multi-fluid drilling system comprising:

a drill string configured to enable separate and independent flow of a first fluid and a second fluid;

a hammer supported by the drill string and in fluid communication with the drill string wherein the first fluid is able to power the hammer; and a motor supported by the drill string and in fluid communication with the drill string wherein the second fluid is able to flow through and power the motor, the motor arranged to rotate the hammer.

In a third aspect there is disclosed a method of drilling a hole comprising:

coupling a motor to a hammer the motor being capable of rotating the hammer drill;

delivering first and second fluids separately and independently of each other through a drill string to the hammer and the motor respectively wherein the first fluid powers the hammer to cyclically impact a toe of a hole being drilled; and the second fluid powers the motor, in isolation of the first fluid, to enable to the motor to rotate the hammer.

BRIEF DESCRIPTION OF THE DRAWINGS

Notwithstanding any other forms which may fall within the scope of the system and method as set forth in the Summary, a specific embodiment will now be described by way of example only with reference to the accompanying drawing in which.

DETAILED DESCRIPTION OF SPECIFIC EMBODIMENTS

Figure 1:
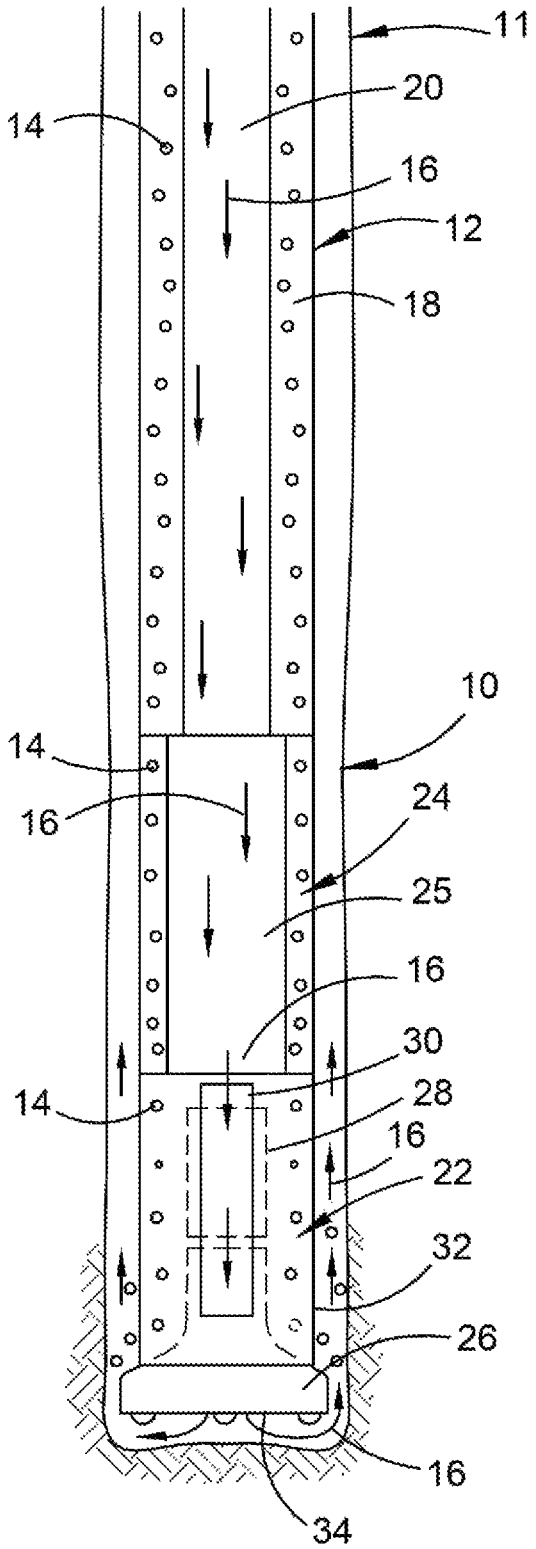
FIG. 1 is a schematic representation of a first embodiment of the disclosed multi-fluid drilling system.

FIG. 1 illustrates one embodiment of the disclosed multi-fluid drilling system 10 drilling a hole or well 11. The system 10 is coupled to a dual wall drill string 12. The drill string 12 is configured to enable separate flow of a first fluid 14 depicted by circles and a second fluid 16 depicted by arrows. In this instance the first fluid 14 flows in an outer annular path or channel 18 of the drill string 12 while the second fluid 16 flows through an inner channel or flow path 20. The system 10 comprises a hammer 22 and a downhole motor 24. Both the hammer 22 and the motor 24 are supported by and are coupled to the drill string 12. The motor 24 is uphole of the hammer 22.

The hammer 22 is arranged so that when supported by the drill string 12 the first fluid 14 when flowing through the drill string 12 is able to flow to and power the hammer 22. As the motor 24 is disposed between the hammer 22 and the drill string 12 the first fluid 14 is also able to flow through the motor 24. To this end the motor 24 has a channel 25 to enable the first fluid to flow from the drill sting 12 to the hammer 22. The channel 25 acts as a part of a flow path or conduit for the first fluid 14.

The hammer 22 is of generally conventional construction and includes amongst other features, a hammer bit 26, a piston 28, and a central tube 30. The hammer 22 also includes a porting arrangement (not shown) through which the first fluid 14 flows. The porting arrangement comprises a plurality of surfaces formed on the piston 28 and on an inner circumferential surface of a porting sleeve (not shown). The piston 28 is caused to reciprocate along the central tube 30 by action of the fluid 14 passing through the porting arrangement. This provides impact force onto the bit 26. The fluid 14 is then exhausted generally between the outside of the bit 26 and an outer casing 32 of the hammer 22.

The motor 24 is driven by the flow of the second fluid 16. The second fluid 16 when passing through the motor 24 causes a rotor (not shown) in the motor 24 to rotate relative to the corresponding stator (not shown). The rotor is coupled to the hammer 22. Thus when fluid 16 passes through the motor 24, the hammer 22 including the associated hammer bit 26 rotate.

In this embodiment the second fluid 16 is caused to flow through the central tube 30 and subsequently through an internal passage in the hammer bit 26. This passage opens onto a bit face 34. The fluid 16 is then able to flow across the bit face 34 and subsequently back up the hole/well 11 being drilled by the system 10. The fluids 14 and 16 mix as they travel back up the hole/well 11.

Figure 2:
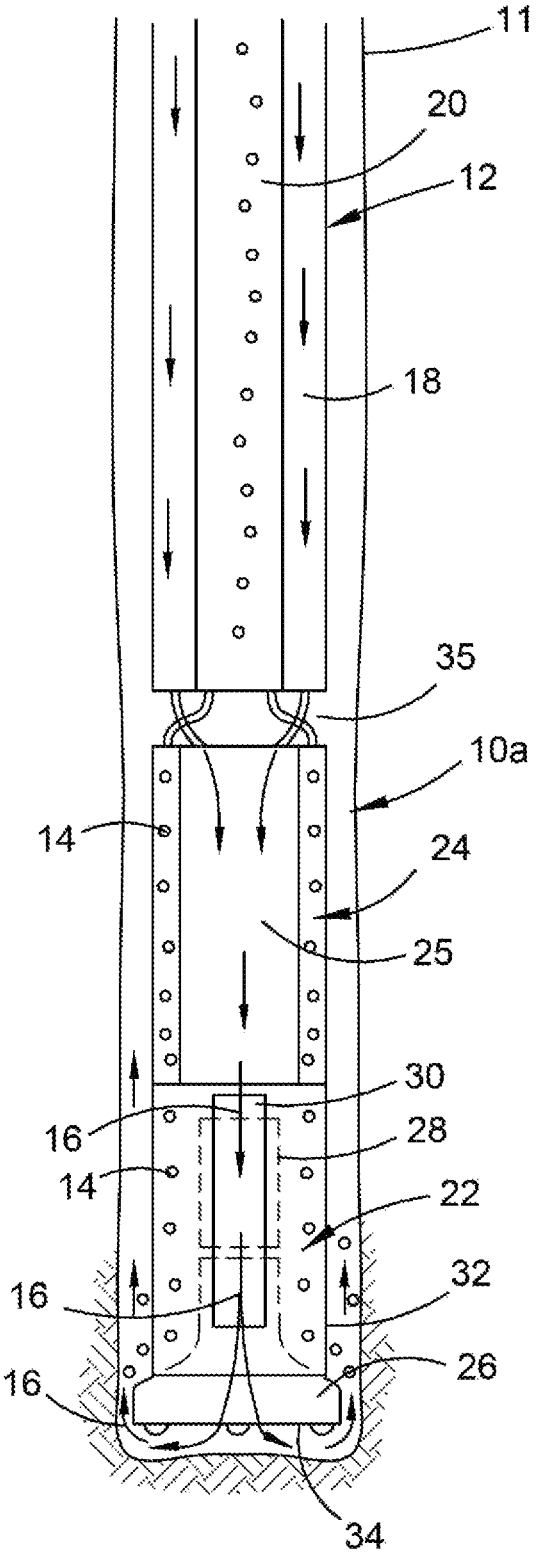
FIG. 2 is a schematic representation of a second embodiment of the disclosed multi-fluid drilling system.

FIG. 2 illustrates a second embodiment of the disclosed system 10*a*. The same reference numbers used in FIG. 1 to describe features of the system 10 above are used in FIG. 2 to denote the same features of the system 10*a*. The system 10*a* is in substance the same as the system 10 however the first fluid 14 in this embodiment flows through the inner channel 20 while the second fluid 16 passes through the annular channel 18. As a result of this the system 10*a* also includes a crossover sub 35 between the drill string 12 and the motor 24. The crossover sub 35 crosses the flow paths of the first and second fluids 14 and 16 from the drill string 12 to the motor 24 so that: the second fluid 16 remains flowing through the channel 25 in the motor 24 and subsequently through the inner tube 30 of the hammer 22; and, the first fluid 14 is directed to the porting arrangement of the hammer 22.

Figure 3:
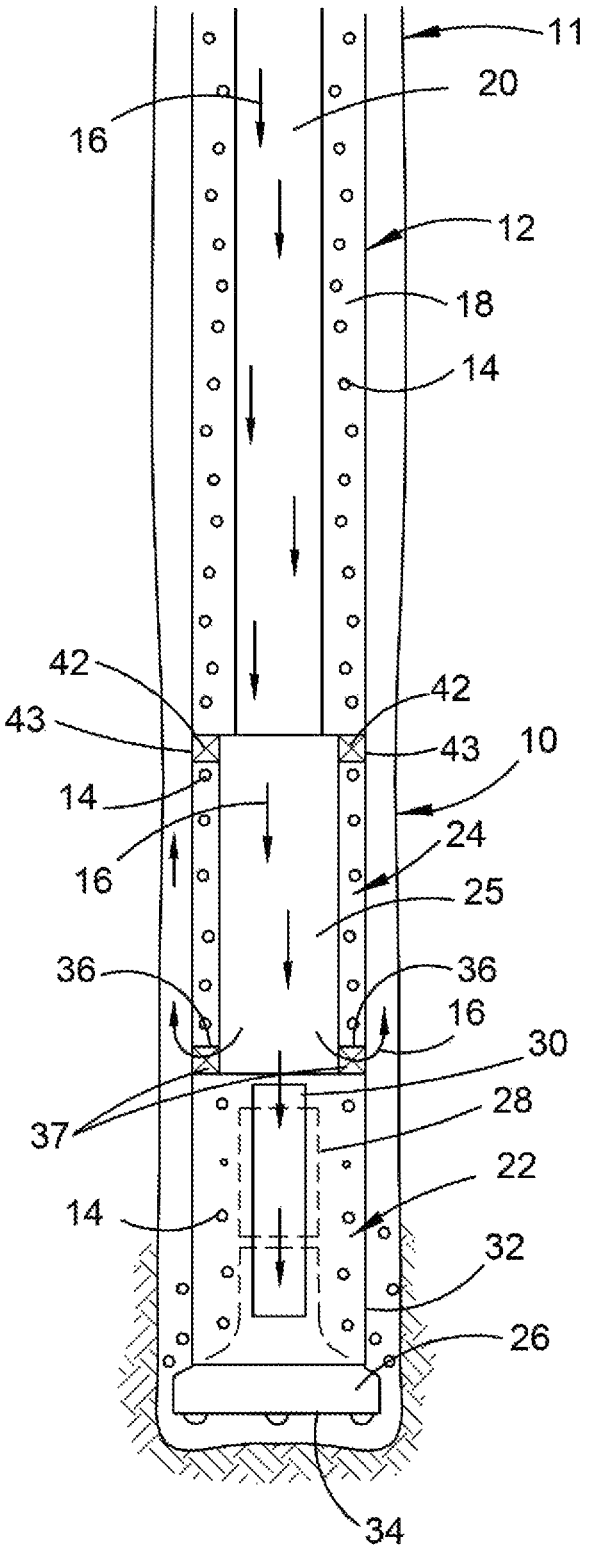
FIG. 3 is a schematic representation of a third embodiment of the disclosed multi-fluid drilling system.

FIG. 3 illustrates a further embodiment of the disclosed system designated as 10*b*. The same reference numbers used in FIG. 1 to describe features of the system 10 above are used in FIG. 3 to denote the same features of the system 10*b*. The system 10*b* differs from the system 10 only by way of the outlet or exit points for the second fluid 16. In the system 10*b* the second fluid 16 exits the system 10 near but uphole of the hammer 22. This is achieved by the provision of ports 36 in the motor 24 which enable the second fluid 16 to flow out of the motor 24 uphole of the hammer 22 and into the hole being drilled. In this embodiment the first fluid 14 continues to flow through the motor 24 and to the hammer 22 to cause reciprocation of the piston 28 and thus provide the impact force for the hammer bit 26. The fluid 14 exits the system 10*b* from between the outer housing 32 and the bit 26. Again both fluids 14 and 16 will mix in the hole 11 and flow upward to bring drill cuttings to the surface.

Figure 4:
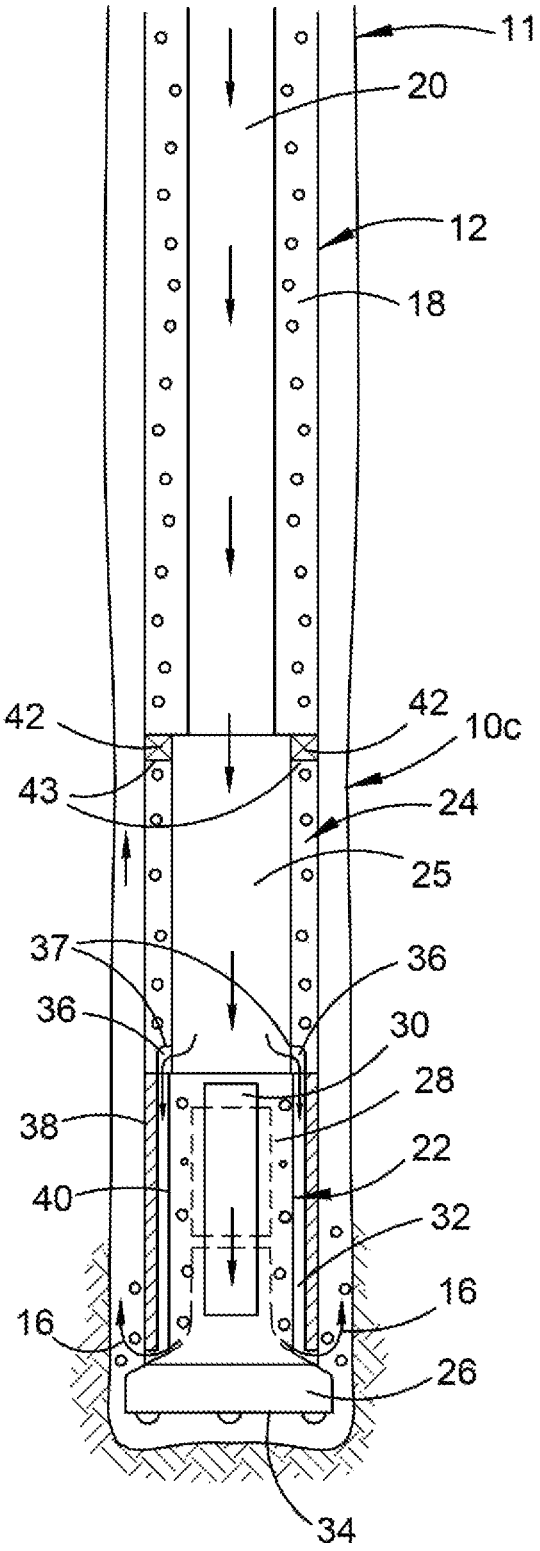
FIG. 4 is a schematic representation of a fourth embodiment of the disclosed multi-fluid drilling system; and, FIG. 5 is a schematic representation of a fifth embodiment of the disclosed multi-fluid drilling system.

FIG. 4 depicts a further embodiment designated as system 10*c*. The system 10*c* is a variation of the system 10*b*. The variation lies in a minor reconfiguration of the ports 36 and the addition of an external shroud 38. The shroud 38 extends over the outer housing 32 of the hammer 22. The shroud 38 and outer housing 32 are configured so to form an annular flow path 40 there between. The port 36 is arranged to direct the fluid 16 to flow through the flow path 40. The second fluid 16 then exits the system 10*c* adjacent the head of the hammer bit 26 but upstream of the bit face 34. The first fluid 14 also exits the system 10*c* from between a lower end of the outer housing 32 and the hammer bit 26. Thus in this instance both the fluids 14 and 16 exit from substantially the same location on the drill system 10*c* and flow upwardly to carry drill cuttings to the surface.

Each of the systems 10*b* and 10*c* shown in FIGS. 3 and 4 respectively can be further modified in a manner so as to cause the fluid 16 to in essence bypass the motor 24 and thus be pumped directly into the hole being drilled rather than operate the motor 24. To modify the systems 10*b* and 10*c* to operate in this manner both require further exit ports 42. The ports 42 are upstream of the ports 36.

In these modified embodiments each of the ports 36 and 42 is also provided with valves 37 and 43 respectively. The valves 37 and 43 can be selectively and independently opened and closed.

By closing the valves 43 in the upstream ports 42 and opening the valves 37 in the downstream ports 36, the systems 10*b* and 10*c* operate as previously described. However if the valves 37 in the ports 36 are closed and the valves 43 in the ports 42 opened then the fluid 16 is caused to substantially bypass the motor 24 and flow directly in to the hole being drilled. Consequently the motor 24 will provide very little if any rotational torque to the hammer 22. In that event, rotation of the hammer 22 and the corresponding hammer bit 26 may be provided by an uphole rotation head or turntable coupled to the drill string 12. In both instances the fluid 16 will be pumped into the hole/well 11.

Figure 5:
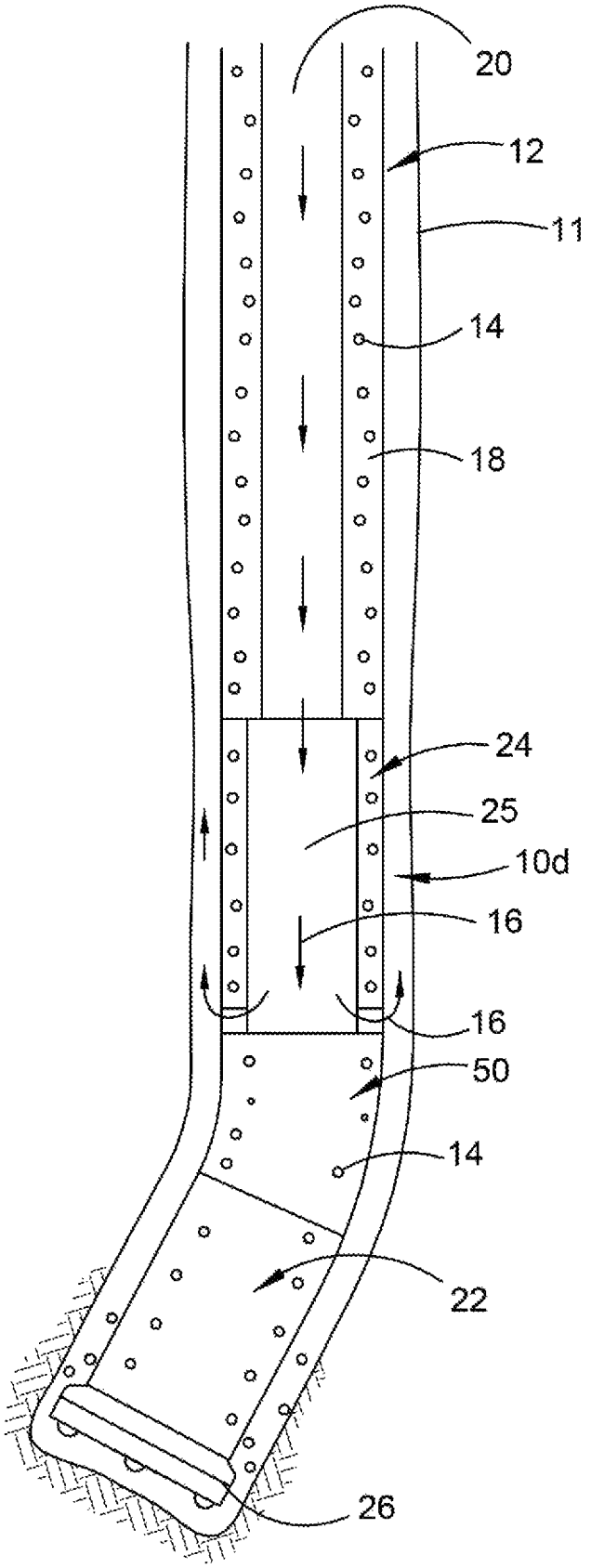

FIG. 5 shows a further embodiment of a disclosed system designated here as 10*d*. The same reference numbers used in FIG. 1 to describe features of the system 10 above are used in FIG. 5 to denote the same features of the system 10*d*. The system 10*d* differs from the earlier systems 10-10*c* by the inclusion of a steering mechanism 50. The steering mechanism 50 is illustrated in this embodiment as being disposed between the hammer 22 and the motor 24. However in an alternate embodiment the steering mechanism 50 may be located between the end of the drill string 12 and the motor 24. It is however generally preferable to have the steering mechanism as close as possible to the bit face 34. In its simplest form the steering mechanism may be incorporated as a bent housing in the motor 24 or by using a bent sub or eccentric stabiliser. Thus although the steering mechanism 50 is shown as being separate from the motor 24 it may be incorporated as part of the motor 24.

The provision of the steering mechanism 50 enables the drilling system 10*d* to be used for directional drilling. In such when drilling a straight section of the hole (e.g. before and after a bend) the hammer 22/hammer bit 26 are rotated by rotating the drill string 12. In one embodiment when it is required to change the direction of drilling the second fluid 16 is delivered through the string 12 to the motor 24. This will activate the steering mechanism to deflect the line of drilling of the hammer 22 and associated bit 26 in comparison to the line of the drill string 12. Once the appropriate bend has been drilled, delivery of the second fluid 16 can cease and rotation is again provided by rotating the string 12 using for example a drill head or turntable. However other known bent subs or steerable subs/joints may be used to provide directional control of the hole/well 11 being drilled which are actived without the need to stop the flow of the second fluid 16. Indeed this is favoured in most circumstances so as to maintain a desired down hole pressure and continuous flushing and stabilisation of the hole/well 11.

The steering mechanism 50 may be introduced into each of the system 10*a*, 10*b* and 10*c* described above. In particular when used in conjunction with the modified forms of systems 10*b* or 10*c* having the valve controlled ports 36 and 42, it is possible to maintain a flow of the second fluid 16 into the hole/well 11 irrespective of whether while forming a bend or turn in the hole/well 11. The steering mechanism may be incorporated as part of the motor 24 in all of the embodiments.

In each of the above described embodiments the first fluid 14 can be a gas or a liquid (i.e. compressible or incompressible fluid). The first fluid 16 can be a gas such as air if the hole depths and pressure differentials are such that air can be delivered at sufficient pressure and flow rate/volume to operate the hammer 22. Alternately the first fluid 14 can be a liquid (i.e. incompressible fluid) such as but not limited to water. This may be beneficial when drilling deep holes in order to provide the pressure differential to operate the hammer 22. The term "water" in the context of the first fluid 14 in operating or powering the hammer 22 is intended to be reference to clean water or relatively clean water with an acceptably small fraction of small particulate matter. For example the water can have a purity of 5p. This is to be distinguished from dirty water or muds which essentially are water mixed with significant fractions of relatively large particulate matter. It is indeed known to use mud to down hole hammers. However such hammers have a short service life as the mud has an abrasive effect on the internal workings of the hammer and in particular the porting surfaces. This leads to rapid degradation of performance and the necessity to change the hammer 22 on a regular basis.

The second fluid 16 which flows in isolation to the first fluid 14 can be chosen, in addition to providing power to drive the motor 24, to have characteristics to control downhole conditions, provide lubrication to the bit face 34 and flush cuttings from the hole/well 11. The fluid 16 may be but is not limited to gases, water, dirty water, drilling mud, drilling additives, lubricants and a combination of two or more of these.

Although the first fluid 14 is not crucial in terms of controlling downhole pressure conditions it's density and viscosity can be taken into account when selecting the second fluid 16 so that the mixture of the fluids 14 and 16 provide a desired downhole pressure condition. Thus, one can select or modify the characteristics of the second fluid 16 to provide the desired downhole conditions taking into account, but without requiring any change of, the first fluid 14.

In the event that dangerous conditions are detected it is possible to provide second fluid 16 at sufficient volume and flow rate to kill the well. This arises due to the manner in which the second fluid 16 is delivered which provides for a substantially greater volume of liquid than with a traditional down hole fluid hammer.

The above the systems 10-10*d* enable a method of drilling a hole or well in the ground using a fluid operated hammer 22 with an adjacent fluid operated motor providing torque. Separate fluids 14 and 16 are used to drive the hammer 22 and the motor 24. The fluids may be matched to the prevailing down hole conditions and/or for optimum operation of the hammer and/or the motor 24. The fluids 14 and 16 may be pumped into an up hole end of the drill string 12 using a dual circulation fluid inlet swivel. The above described embodiments of the system and associated drilling method are particularly, but not exclusively, suited to drilling: oil and gas; or geothermal wells in hard ground formations, or drilling very deep holes, such as for example depth in excess of 5000 m. In particular, embodiments of the disclosed system and method enable the use of down the hole drilling tools in the form of down the hole hammers which are very well suited to drilling in hard materials although do not find favour when drilling for oil/gas due to the trade-off between longevity of the drilling tool and the ability to control down hole pressure and maintain hole stability. For example to drill with a marginal under pressure, when using a regular down hole hammer, it may be required to operate the hammer with a fluid of a relatively high specific gravity. This will entail using a mud or slurry to drive the hammer. However by its very nature the mud or slurry will contain particles that abrade and wear the hammer. As a result it becomes necessary to trip the drill string more regularly in order to replace the worn hammer. When a hole is several kilometres deep, the tripping of the drill string may take up to or exceed 24 hours. However if a hammer driving fluid of lower specific gravity is used then the ability to provide a specific pressure condition may be lost. Embodiments of the system and method enable separate provision and control of the parameters and characteristics of the working and flushing fluids thereby enabling maximum efficiency and longevity of the down hole tool while also providing control over down hole pressure and hole stability.

Embodiments of the presently disclosed system and method use two separate fluid flows all the way to the bottom of the drill string 12 and in many embodiments the well/hole 11. Consequently the fluids 14 and 16 will mix at or very close to the bit face 34 i.e. the bottom of the well 11. This allows for well control with maximum effect and safety and for the mixing of the both fluids at or very near the bit face.

The ratio between the first fluid 14 and the second fluid 16 may be between 10/90 and 30/70. That is 10% first fluid 16 and 90% second fluid 18. This means for example during the drilling of a 8.5 inch well using 5.5 inch drill pipe, an embodiment of the disclosed the hammer 22 will use 10% to 30% of the total well volume as a first fluid 16.

Looked at in terms of fluid volumes and pressures, say for example the total volume of fluid required to drill and lift drill cuttings is 1,000 litres per minute pumped at a pressure of 5,000 psi. The hammer 22 will use 100 to 300 litres per minute of that total volume. The second fluid will be pumped at around 4,000 psi and the flow rate will be 900 to 700 litters per minute.

Thus embodiments of the disclosed the system and method are very efficient in comparison to say a normally operated water hammer. In comparable downhole environment and depth, a normally operated water hammer would typically use over 1,000 litres per minute and up to 2,000 litres per minute. This is substantially more than the 100-300 litres per minute of embodiments of the disclosed system and method.

In the disclosed system and method the provision of separate fluid flows for the motor and hammer enables "tuning" of the drilling process wherein the rotation speed/torque and percussive energy of the hammer bit can be separately controlled. The rotation speed/torque of the hammer bit 26 can be controlled by controlling the flow and other characteristics of the second fluid 16 which drives the motor 24. The percussive energy of the hammer bit 26 can be controlled by controlling the flow and other characteristics of the first fluid 14. Thus for example it is possible drill with low bit rotation speed and high bit percussive energy impact speed; or high bit rotation speed and low bit percussive energy; or indeed more generally any combination of bit rotation speed and bit percussive energy.

The motor 24 may be in the form of a vane or turbine type motor. Such a motor has a central drive shaft that is coupled to the hammer 22 to rotate the hammer 22. The central drive shaft is provided with a bore which forms the channel 25. Alternatively the drive shaft may be provided with a bore and an inner rotationally decoupled sleeve that forms the channel 25.

Embodiments of the system and method may be used on either land or offshore rigs. In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosed system and method.

The invention claimed is:

1. A multi-fluid drilling system capable of being coupled to an end of a dual wall drill string configured to enable separate and independent flow of a first fluid and a second fluid in a first flow path and a second flow path respectively, wherein one of the first and second flow paths in an annular flow path and another of the flow paths is an inner flow path surrounded by the annular flow path, the system comprising:

a hammer arranged so that when supported by the dual wall drill string a first fluid flowing through the drill string is able to power the hammer;

a downhole motor arranged so that when supported by the drill string a second fluid flowing through the drill string is able to flow through and power the downhole motor;

the downhole motor being coupled to the hammer and arranged to rotate the hammer when the second fluid flows through the motor, wherein the downhole motor is disposed between the hammer and the dual wall drill string; and wherein the drilling system is arranged to enable the first fluid and the second fluid to flow into a hole being drilled by the drilling system.

2. The drilling system according to claim 1 wherein the hammer is provided with a hammer bit and the first fluid is directed through the drilling system to exit the drilling system adjacent the hammer bit.

3. The drilling system according to claim 1 wherein the hammer is provided with a hammer bit and the second fluid is directed through the drilling system to exit the drilling system so as to flow across a bit face of the hammer bit.

4. The drilling system according to claim 1 wherein the hammer is provided with a hammer bit and the second fluid is directed through the drilling system to exit the drilling system up hole of a bit face of the hammer bit.

5. The drilling system according to claim 4 comprising a shroud located over the hammer and terminating up hole of the bit face and wherein the second fluid exits the drilling system from a down hole end of the shroud.

6. The drilling system according to claim 1 comprising an arrangement of ports associated with the downhole motor for selectively causing the second fluid to flow into the hole being drilled: prior to imparting substantive power to the downhole motor, or, after imparting power to the downhole motor.

7. The drilling system according to claim 1 comprising a steering mechanism coupled between the drill string and the hammer.

8. The drilling system according to claim 7 wherein the steering mechanism is either located between the downhole motor and the hammer, or incorporated in the downhole motor.

9. The drilling system according to claim 1 comprising a topsides rotation system arranged to rotate the hammer by imparting torque to the drill string.

10. The system according to claim 1 wherein the first and second fluids are in the form of respective liquids having at least one different characteristic, wherein the characteristics comprise: specific gravity, viscosity, rheology, pressure and flow rate.

11. A method of drilling a hole comprising:

coupling a downhole motor to a hammer, the downhole motor being capable of rotating the hammer;

delivering first and second fluids separately and independently of each other through a dual wall drill string to the hammer and the downhole motor respectively wherein the dual wall drill string has an outer annular flow path through which one of the first and second fluids flow, and an inner flow path surrounded by the annular flow path through which another of the first and second fluid flow; wherein the first fluid powers the hammer to cyclically impact a toe of a hole being drilled; and the second fluid powers the downhole motor, in isolation of the first fluid, to enable the downhole motor to rotate the hammer; and allowing the first fluid and the second fluid to flow into the hole being drilled by the drilling system.

12. The method according to claim 11 comprising directing the first fluid into the hole after operating the hammer.

13. The method according to claim 11 comprising directing the second fluid into the hole from at least one of the following locations: across a bit face of a bit of the hammer; up hole of the bit face; and, up hole of the hammer.

14. The method according to claim 11 comprising using a steering mechanism coupled to hammer to cause a changing in direction of the hole being drilled.

15. The method according to claim 14 comprising operating the downhole motor to rotate the hammer when changing the direction of the hole being drilled.

16. The method according to claim 11 comprising coupling the downhole motor to a drill string which is arrange to enable the delivering of the first and second fluids to the hammer and the motor respectively; and transmitting torque to the hammer from a surface rotary table or rotation head via the drill string.

17. A multi-fluid powered drilling system comprising:

a dual wall drill string having an inner flow path and an outer annular flow path surrounding the inner flow path enabling separate and independent flow of a first fluid in one of the outer and inner flow paths and a second fluid in another of the outer and inner flow paths;

a hammer supported by the drill string and in fluid communication with the drill string wherein the first fluid is able to power the hammer;

a downhole motor supported by the drill string and in fluid communication with the drill string wherein the second fluid is able to flow through and power the motor, the motor arranged to rotate the hammer and wherein the downhole motor is disposed between the hammer and the drill string; and wherein the drilling system is arranged to enable the first fluid and the second fluid to flow into a hole being drilled by the drilling system.

18. The drilling system according to claim 17 wherein the hammer is provided with a hammer bit and the second fluid is directed through the drilling system to exit the drilling system so as to flow (a) across a bit face of the hammer, or (b) up hole of the bit face of the hammer bit.

* * * * *